US007942788B2

(12) United States Patent
Wu

(10) Patent No.: US 7,942,788 B2
(45) Date of Patent: May 17, 2011

(54) FOLDABLE TREADMILL

(75) Inventor: Shen-Yi Wu, Taichung (TW)

(73) Assignee: Strength Master Fitness Tech. Co., Ltd., Taichung (TW)

( * ) Notice: Subject to any disclaimer, the term of this patent is extended or adjusted under 35 U.S.C. 154(b) by 0 days.

(21) Appl. No.: 12/458,887

(22) Filed: Jul. 27, 2009

(65) Prior Publication Data

US 2011/0021323 A1 Jan. 27, 2011

(51) Int. Cl.
*A63B 22/02* (2006.01)
*A63B 22/00* (2006.01)

(52) U.S. Cl. ..... 482/54; 482/51

(58) Field of Classification Search ..... 482/54, 482/51

See application file for complete search history.

(56) References Cited

U.S. PATENT DOCUMENTS

| | | | | |
|---|---|---|---|---|
| 5,672,140 | A * | 9/1997 | Watterson et al. | 482/54 |
| 5,803,874 | A * | 9/1998 | Wilkinson | 482/54 |
| 6,059,695 | A * | 5/2000 | Hung | 482/54 |
| 7,291,096 | B2 * | 11/2007 | Ho et al. | 482/54 |
| 7,637,850 | B2 * | 12/2009 | Chen | 482/54 |
| 2007/0066448 | A1 * | 3/2007 | Pan et al. | 482/54 |
| 2009/0005224 | A1 * | 1/2009 | Davis et al. | 482/54 |
| 2010/0016127 | A1 * | 1/2010 | Farnsworth et al. | 482/54 |

* cited by examiner

*Primary Examiner* — Steve R Crow
(74) *Attorney, Agent, or Firm* — Rosenberg, Klein & Lee

(57) ABSTRACT

A foldable treadmill includes a base and two posts are pivotably connected to the base. A handle is pivotably connected between the two posts and includes at least one pivotal end which is connected the two posts. A positioning unit is located between the two posts and includes a transverse link and at least one passive link which has a first end pivotably and is connected to the transverse link. A lever is connected to the transverse link so as to pivot the transverse link. At least one insertion is connected to a second end of the at least one passive link, the pivotal end of the handle having a restriction port with which the insertion is disengageably inserted to restrict the handle from pivoted about the insertion.

20 Claims, 20 Drawing Sheets

FOLDABLE TREADMILL

FIELD OF THE INVENTION

The present invention relates to a treadmill, and more particularly, to a foldable treadmill.

BACKGROUND OF THE INVENTION

A conventional foldable treadmill is shown in FIG. 19 and generally includes a base 80 with two posts 81 which have a front handle 82 and a rear handle 83 connected thereto. The user can pivot the front handle 82 toward rear end of the base 80 to pivot the rear handle 83 which activates the securing device 84 located between the posts 81 and the base 80 to fold the posts 81 toward the base 80.

The front and rear handles 82, 83 are pivoted downward when the posts 81 are positioned upright, however, the rear handle 83 does not well secured so that if the user or any one accidentally touches the front handle 82, the securing device 84 is activated and the posts 81 may drop without any warning and may hurt the user. Besides, the rear handle 83 has to be held during folding the treadmill and this is inconvenient for the users. Furthermore, the folding device is operated by gears which may be stocked if foreign objects enter the gap between the gears.

FIG. 20 shows another conventional foldable treadmill which includes a base 90 with two posts 91 which have a switch 92 so as to control the links 93 in the posts 91 to fold the posts 91 which are secured by being engaging positioning members 94. A similar drawback is that the switch 92 can be accidentally touched to pivot the posts 91.

It is noted that the two posts of the two conventional foldable treadmills are not locked or secured to the base, therefore, when the handle and the switch are accidentally activated, there will be no safety or emergency device to stop the pivoting posts. The un-secured posts are not in a stable status when the user uses the treadmill.

The present invention intends to provide a foldable treadmill which includes two securing units to ensure that the folding action is double checked before being activated.

SUMMARY OF THE INVENTION

The present invention relates to a foldable treadmill and comprises a base with an endless belt mounted thereon and two posts are pivotably connected to the base. The handle is pivotably connected to the two posts and includes a pivotal end. A positioning unit is located between the two posts and includes a transverse link and at least one passive link which has a first end pivotably connected to the transverse link. A lever is connected to the transverse link so as to pivot the transverse link at a mediate portion. At least one insertion is connected to a second end of the at least one passive link. The pivotal end of the handle has a restriction port with which the insertion is disengageably inserted to restrict the handle from pivoted about the insertion.

A first securing unit is located between the base and the two posts and includes a first stop portion which is located on one side of the base. A tubular member including a positioning hole extends from the first stop portion. One of the posts has a second stop portion which is frictionally matched with the first stop portion. A quick release device includes a lever which includes a cam-shaped end and a threaded rod which is pivotably connected to the cam-shaped end. The threaded rod extends through a frame, the second stop portion and is threadedly connected with the inner threads defined in the tubular member so as to engage the second stop portion with the first stop portion.

A second securing unit is connected to a side tube on one of the two posts and includes a first link which has a first end connected with a connection member and a second end of the first link is pivotably connected to a first end of a second link. A second end of the second link is pivotably connected a stop link which extends through the side tube and is engageably inserted into the positioning hole of the tubular member. The connection member extends through the corresponding post connected between the first link and the at least one passive link.

A guiding unit is connected to the two pivotal ends. A connection rod is pivotably connected to the guiding unit and a pivotal link unit. The pivotal link unit is composed of two elongate plates which are pivotably connected to each other. One of the two elongate plates of the pivotal link unit is pivotably connected to the connection rod and the post corresponding thereto, the other elongate plate is pivotably connected to the base. The two elongate plates of the link unit are extended to be straight to support the posts relative to the base when using the treadmill. When folding the treadmill, the handle is pivoted upward and the guiding unit is pivoted to lower the connection rod which pivots the link units about respective pivot points at the base and the posts are able to be pivoted toward the base.

The primary object of the present invention is to provide a foldable treadmill wherein the handle is pivoted downward to be positioned when using the treadmill and upward to be positioned when folding the treadmill.

Another object of the present invention is to provide a foldable treadmill wherein the posts are securely positioned by a securing unit which prevents the post being pivoted by accidentally touched.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
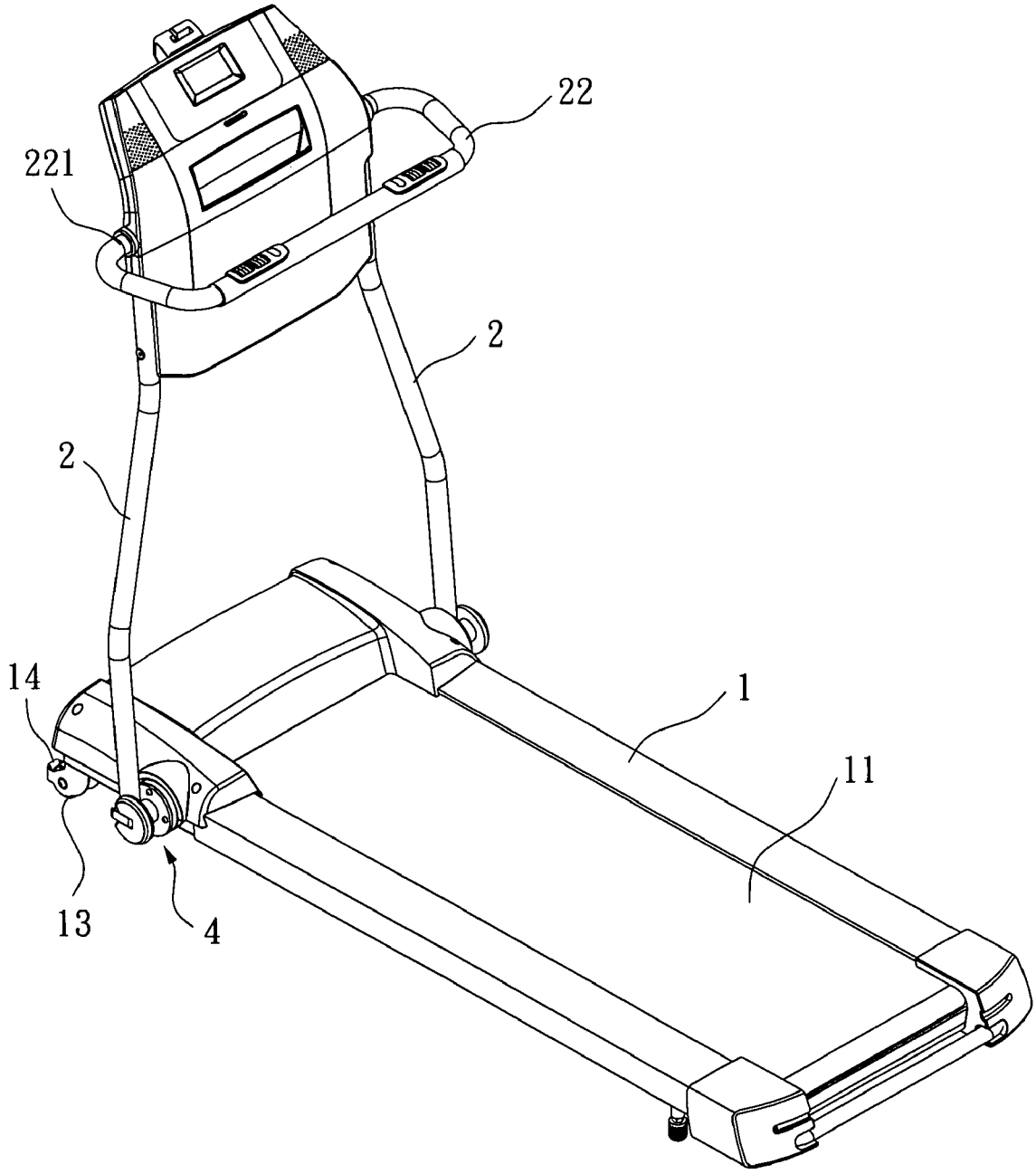
FIG. 1 is a perspective view to show a preferred embodiment of the foldable treadmill of the present invention.
Figure 2:
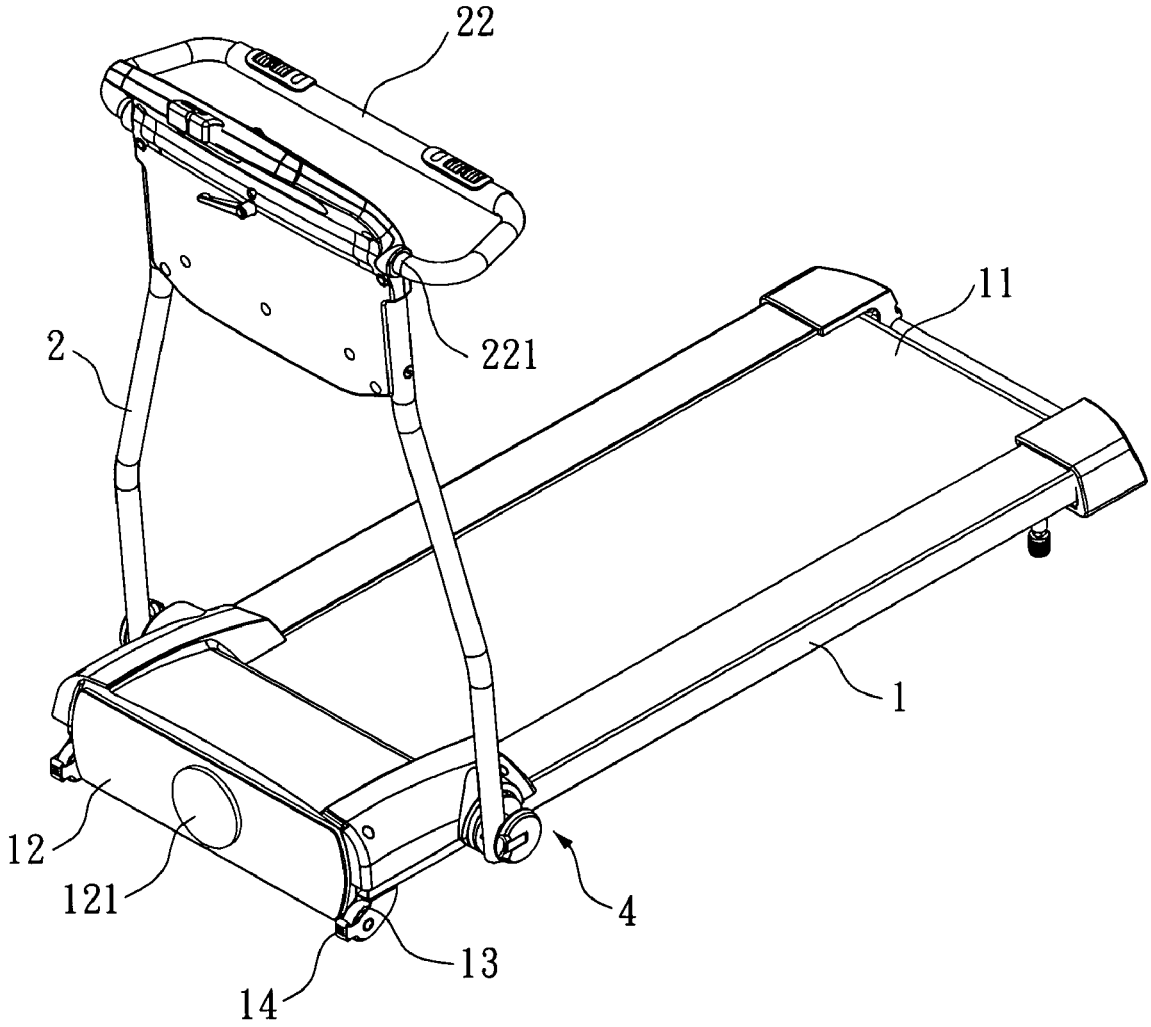
FIG. 2 is a perspective view to show a preferred embodiment of the foldable treadmill of the present invention from another angle.
Figure 3:
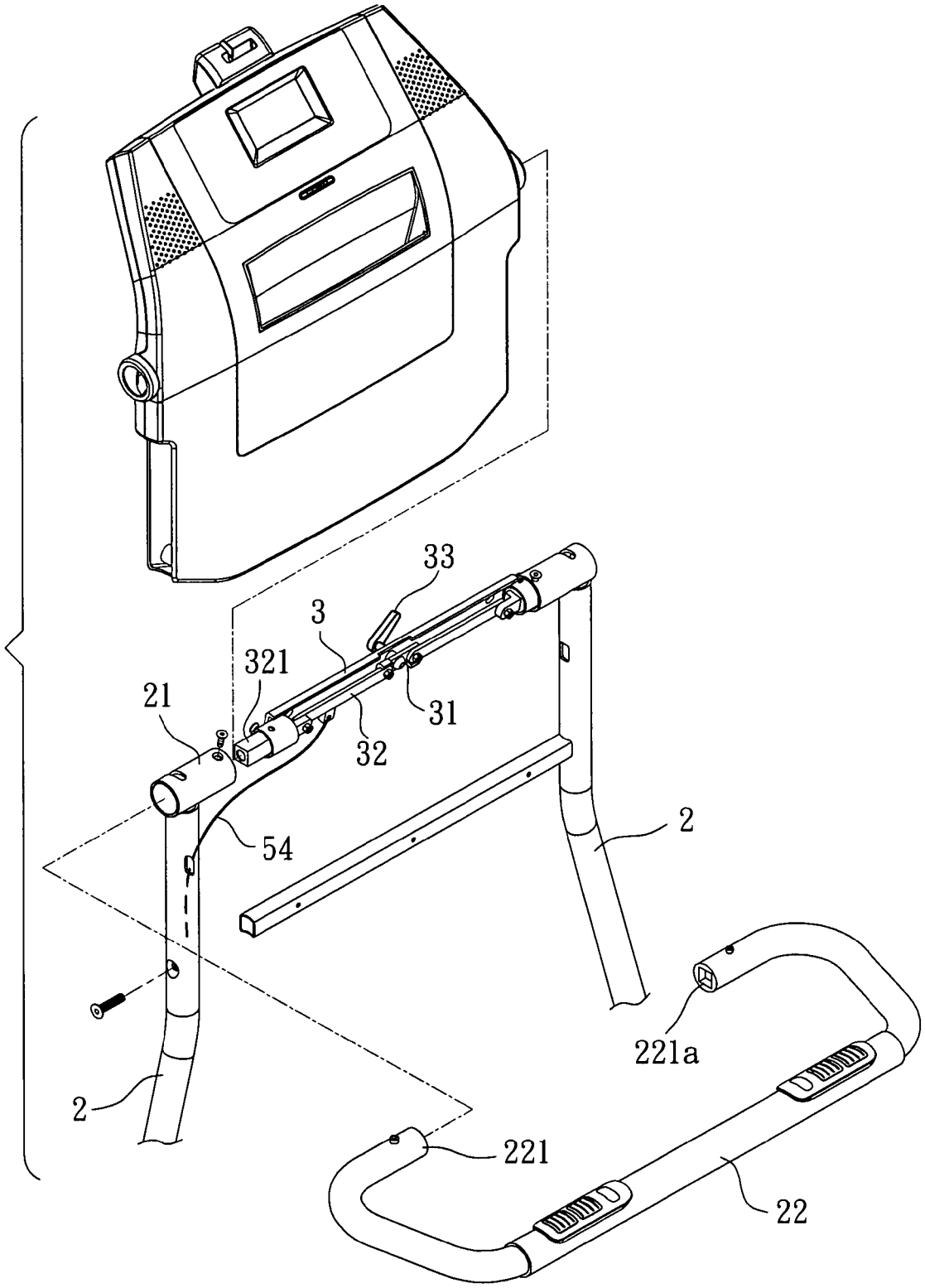
FIG. 3 is an exploded view to show a preferred embodiment of the handle and the positioning unit of the foldable treadmill of the present invention.

Referring to FIGS. 1 to 3, the foldable treadmill of the present invention comprises a base with an endless belt 11 mounted thereon and two posts 2 are pivotably connected to the base 1. Two transverse tubes 21 are respectively connected to two top ends of the two posts 2 and a handle 22 is pivotably connected to the two posts 2. The handle 22 includes two pivotal ends 221 which are connected the two transverse tubes 21 of the two posts 2 respectively.

Figure 4:
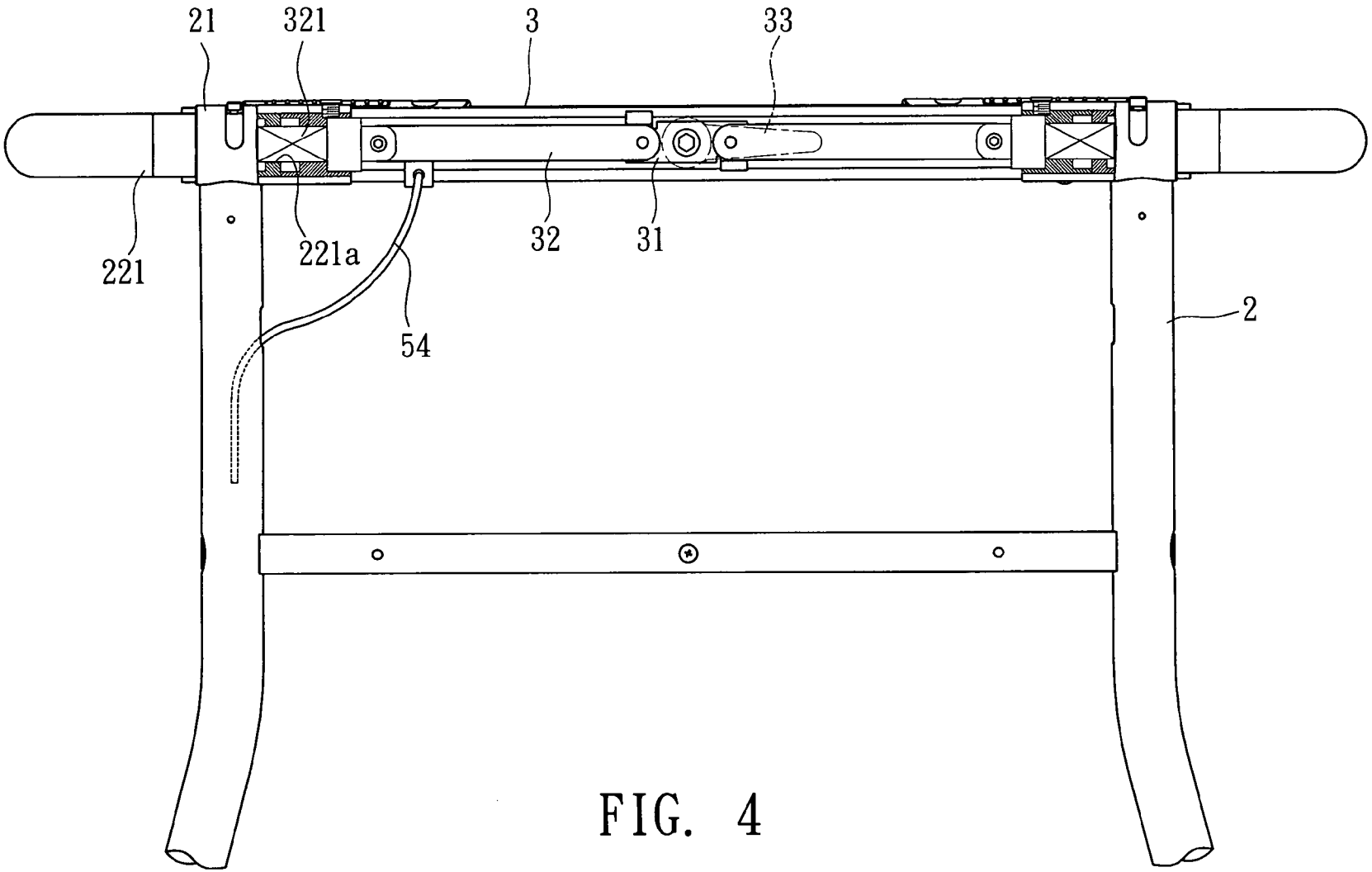
FIG. 4 is a partial cross sectional view to show a preferred embodiment of the connection of the handle and the positioning unit of the foldable treadmill of the present invention.
Figure 5:
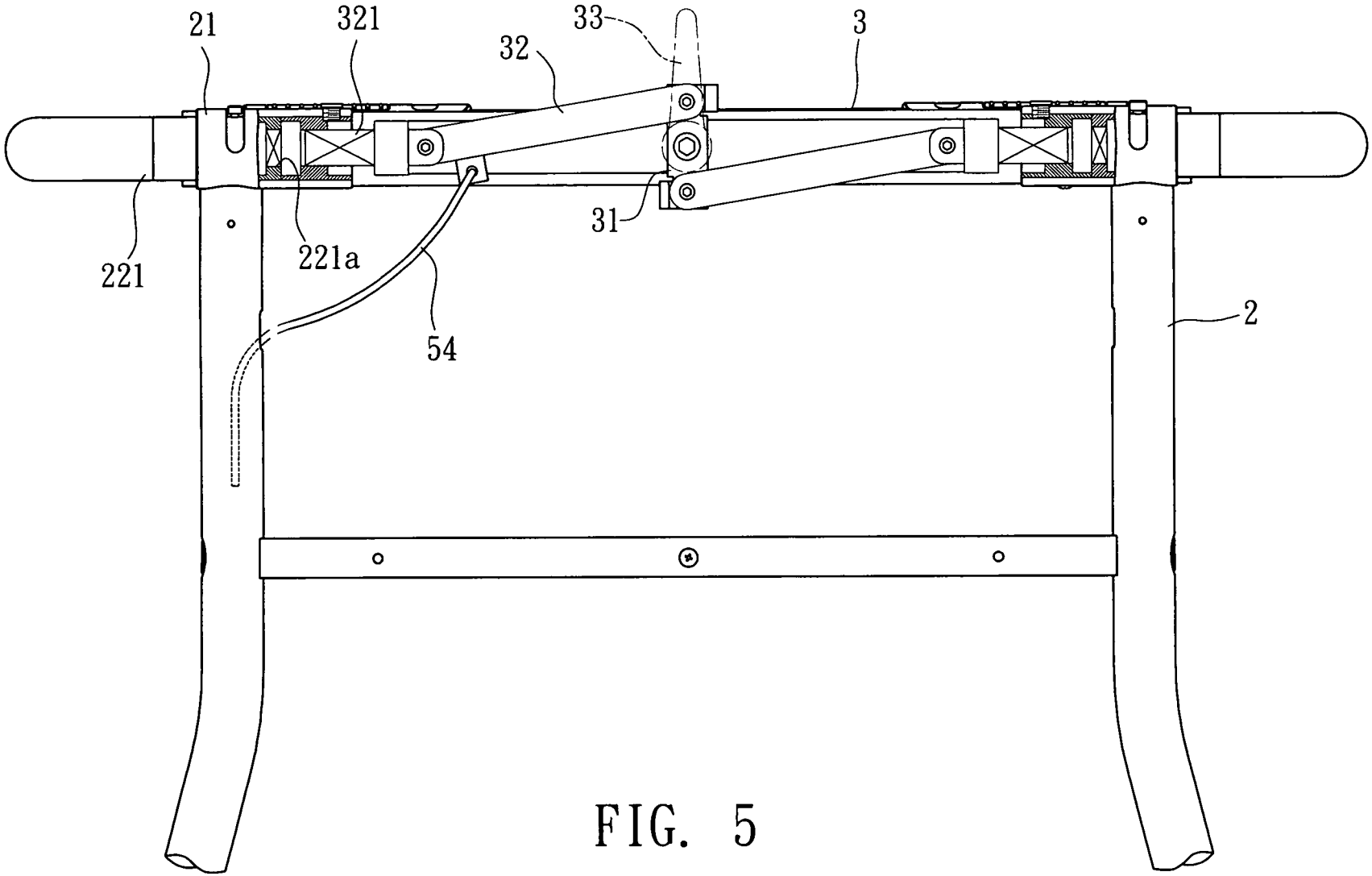
FIG. 5 is a partial cross sectional view to show a preferred embodiment that the lever is operated to pivot the transverse link of the positioning unit of the foldable treadmill of the present invention.

A positioning unit 3, as shown in FIGS. 3 to 5, is located between the two transverse tubes 21 of the two posts 2 and includes transverse link 31 and two passive links 32 which have two respective first ends pivotably and respectively connected to two ends of the transverse link 31. The transverse link 31 is connected with a lever 33 which is pivoted to pivot the transverse link 31 about a pivoting position at a mediate portion of the transverse link 31. Two insertions 321 are connected to two second ends of the two passive links 32 respectively. Each of the two pivotal ends 221 of the handle 22 has a restriction port 221*a* with which the insertion 321 corresponding thereto is disengageably inserted to restrict the handle 22 from pivoted about the two insertions 321.

Figure 6:
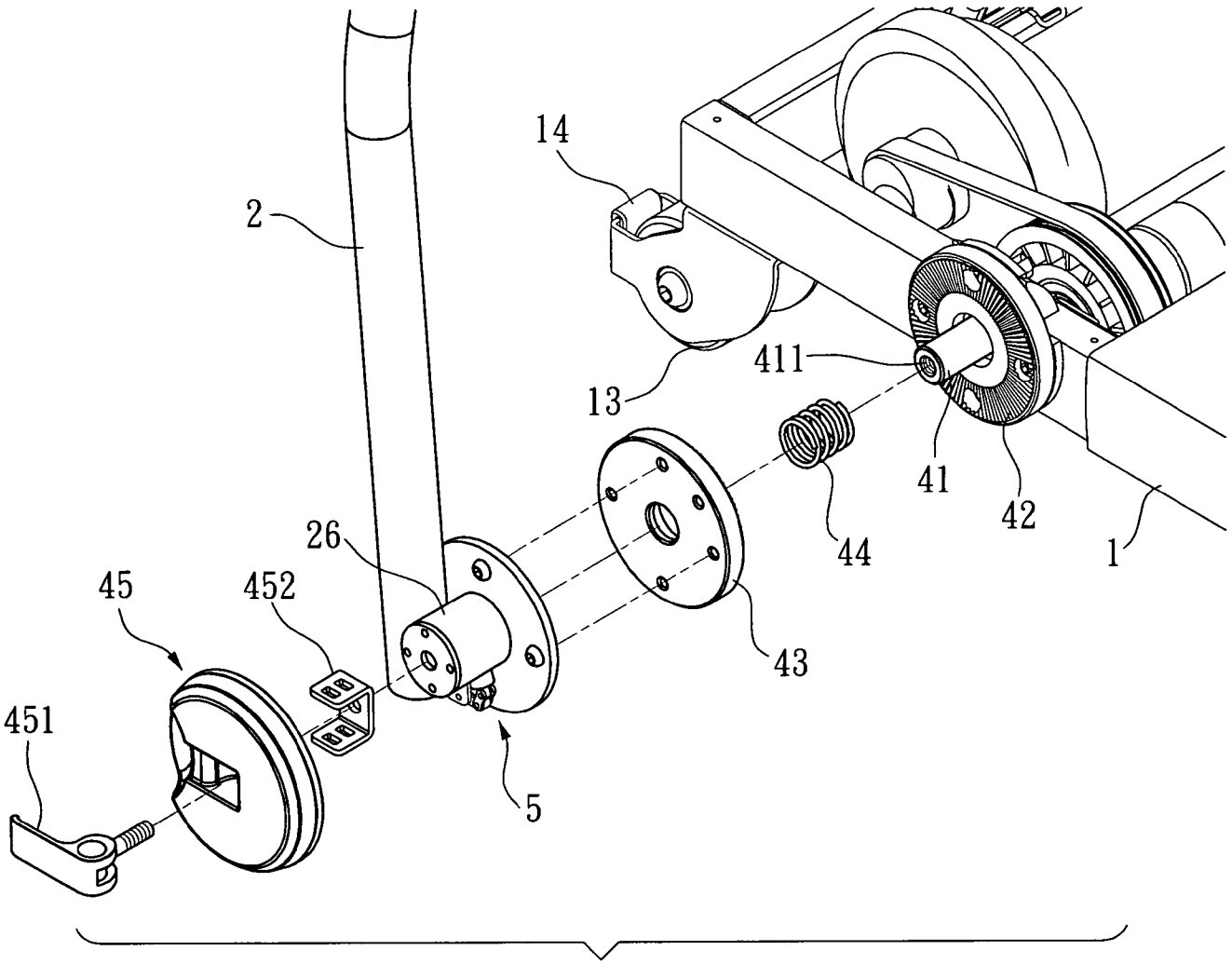
FIG. 6 is an exploded view to show a preferred embodiment of the first securing unit of the foldable treadmill of the present invention.
Figure 7:
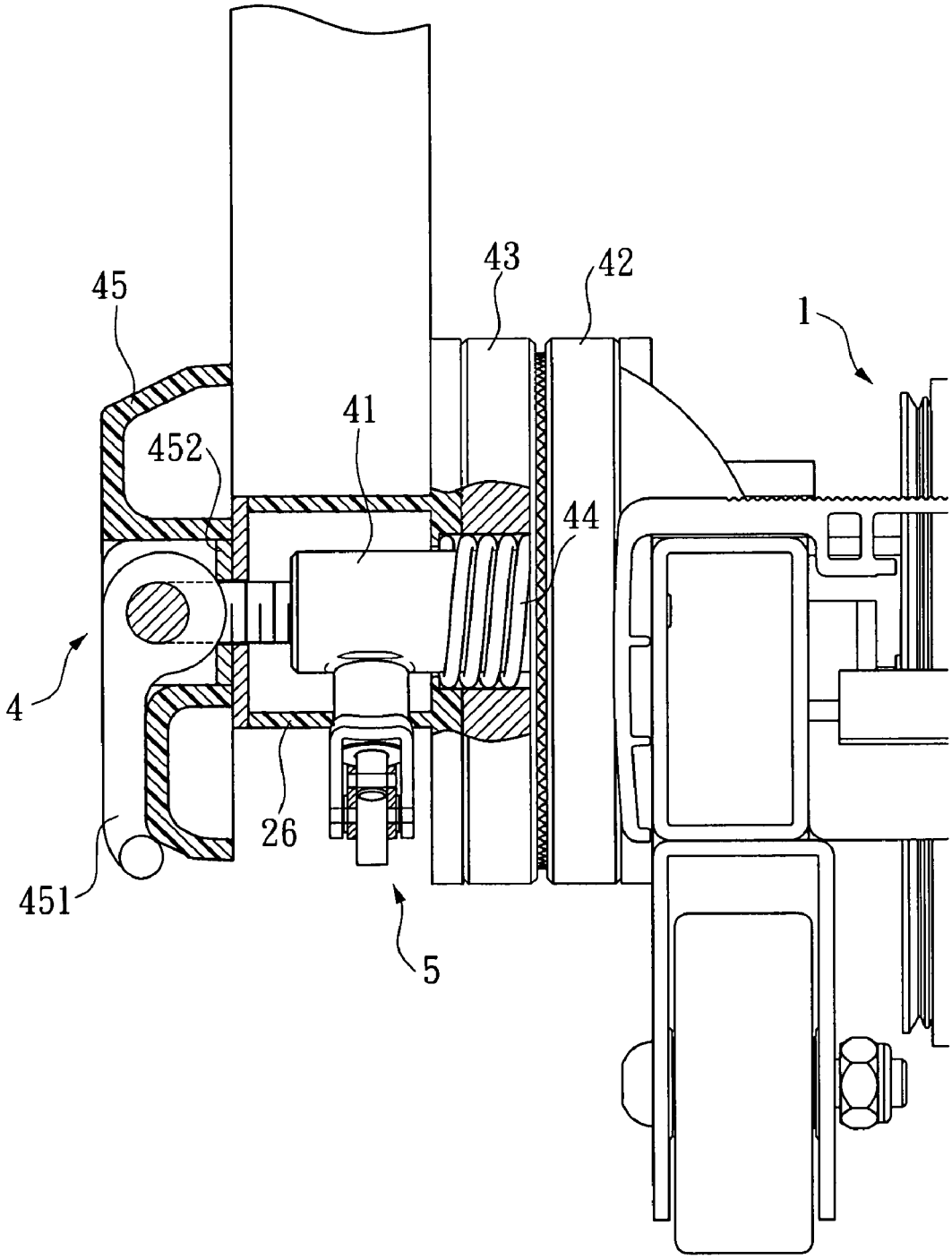
FIG. 7 is a partial end cross sectional view to show a preferred embodiment of the first securing unit of the foldable treadmill of the present invention.
Figure 8:
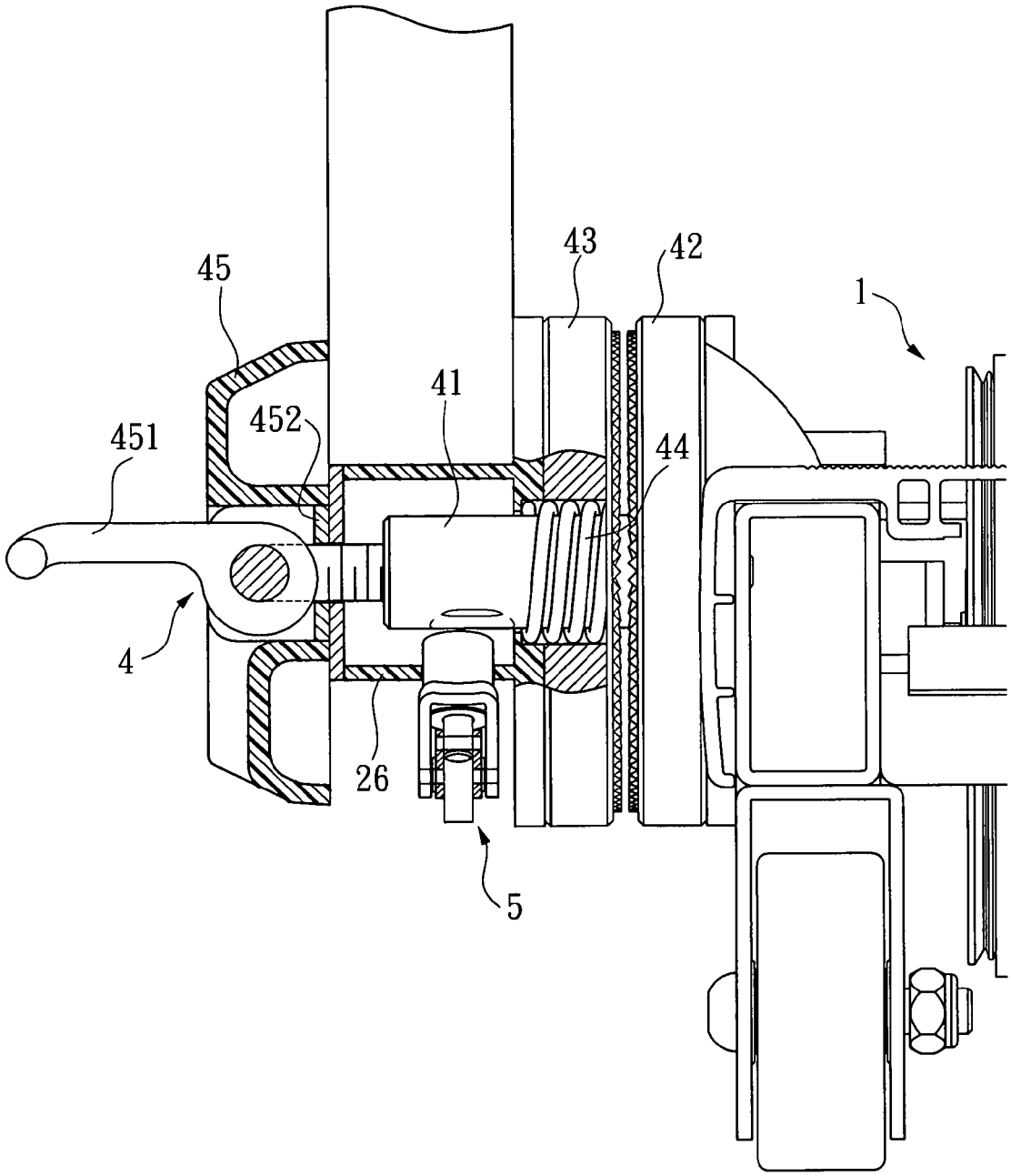
FIG. 8 is a partial end cross sectional view to show a preferred embodiment that the operation lever of the first securing unit is pivoted to disengage from the second stop portion from the first stop portion.

As shown in FIGS. 6 to 8, two first securing units 4 are located between the base 1 and the two posts 2 and each first securing unit 4 includes a first stop portion 42 which is located on one side of the base 1. A tubular member 41 extends from the first stop portion 42 and includes a positioning hole 412 defined radially therein. Each of the posts 2 has a second stop portion 43 which is connected to a side tube 26 on the post 2 and frictionally matched with the first stop portion 42. In this embodiment, the first and second stop portions 42, 43 each have teeth defined in a side thereof so that when the first and second stop portions 42, 43 are matched with each other, the teeth on the two stop portions are engaged with each other. A quick release device 45 includes a lever 451 which includes a cam-shaped end and a threaded rod is pivotably connected to the cam-shaped end. The threaded rod extends through a frame 452, the second stop portion 43 and is threadedly connected with the inner threads 411 defined in the tubular member 41 so as to control the match between the first and second stop portions 42, 43.

Figure 9:
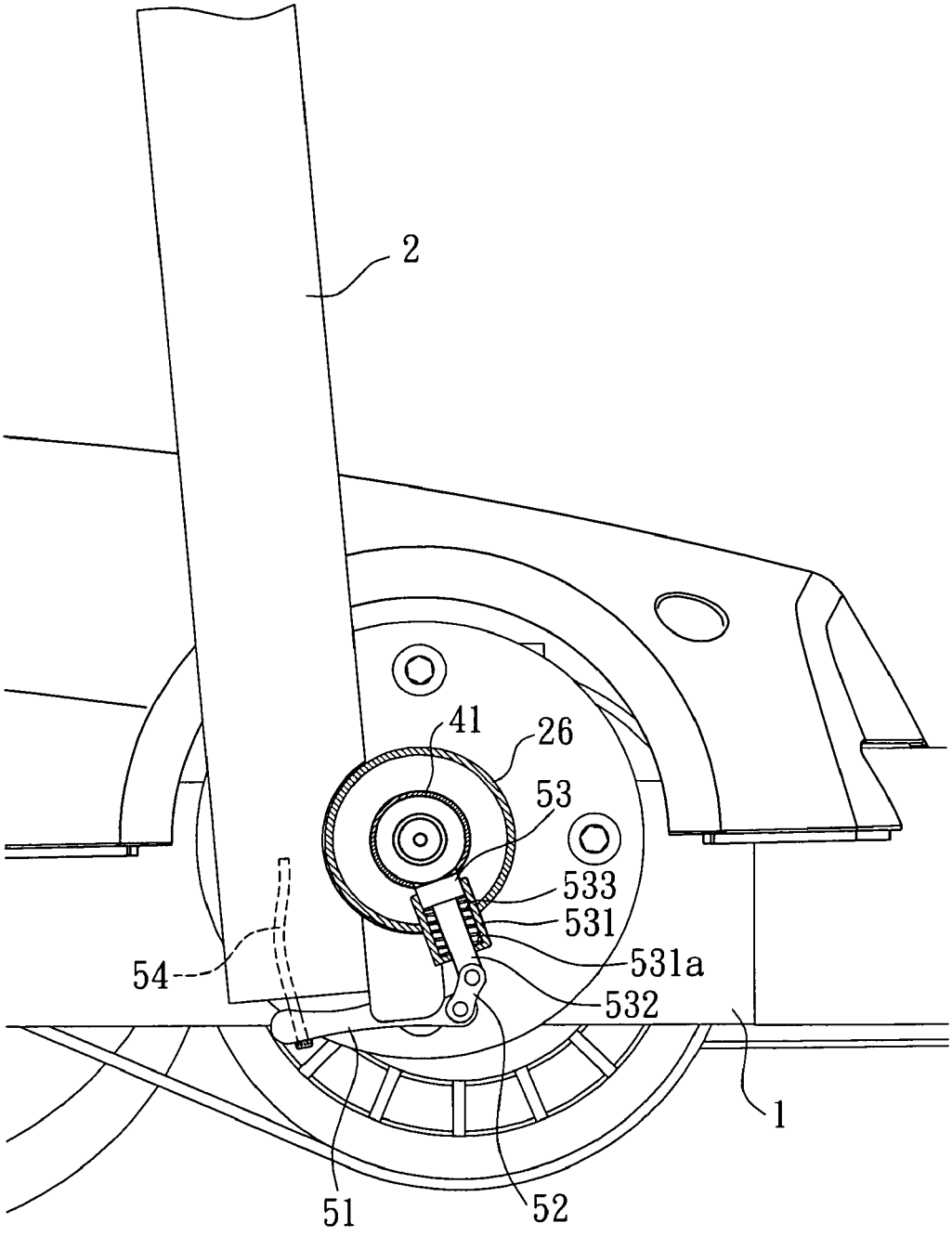
FIG. 9 is a side view to show a preferred embodiment that the stop link of the second securing unit is engaged with the positioning hole of the tubular member of the first securing unit.
Figure 10:
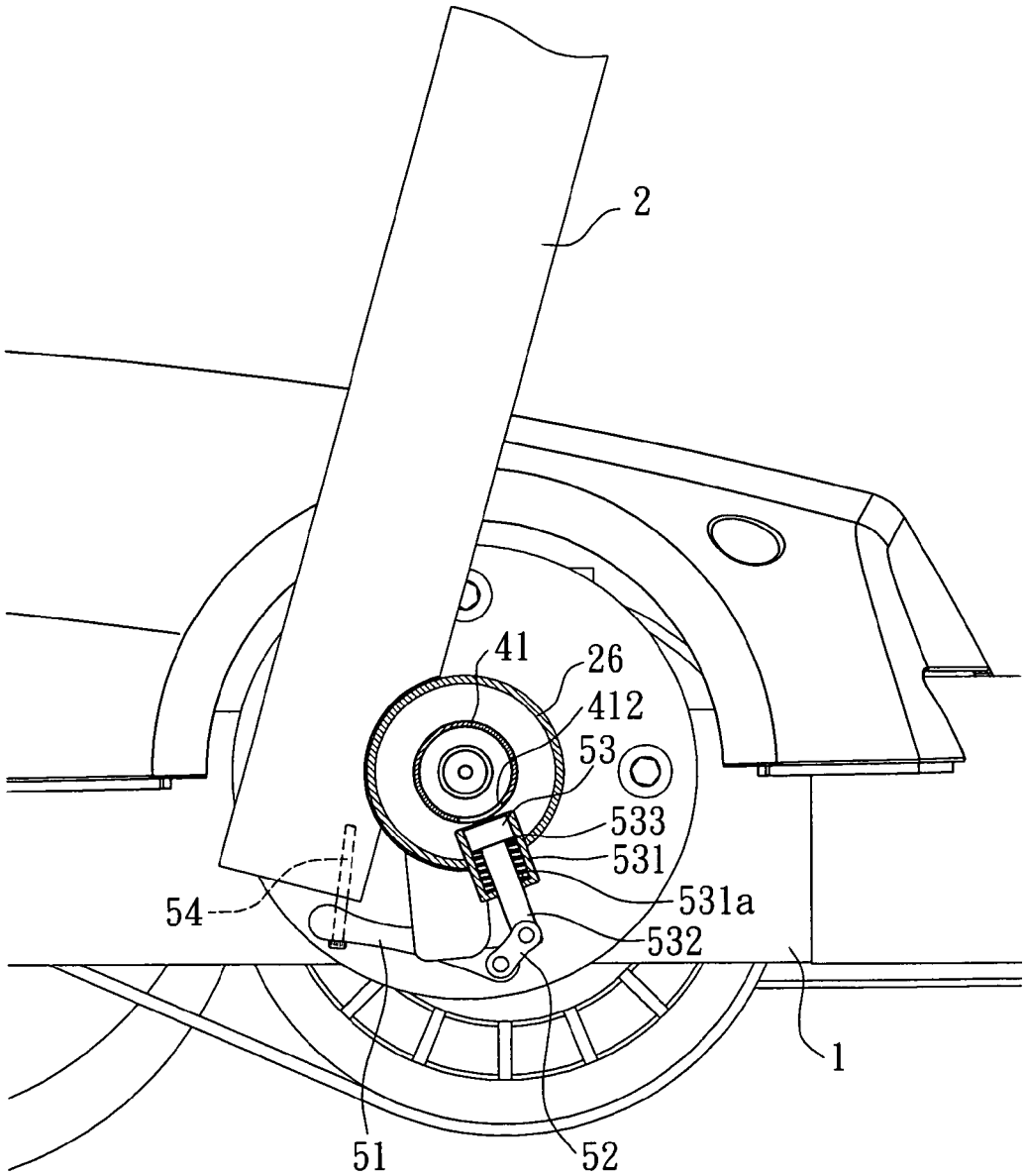
FIG. 10 is a side view to show a preferred embodiment that the stop link of the second securing unit is disengaged from the positioning hole of the tubular member of the first securing unit.

As shown in FIGS. 9 to 10, a second securing unit 5 connected to the side tube 26 on one of the two posts 2 and includes a first link 51 which has a first end connected with a connection member 54 and a second end of the first link 51 is pivotably connected to a first end of a second link 52. A second end of the second link 52 is pivotably connected a stop link 53. The stop link 53 is located within an outer tube 531 and a spring 533 is mounted to a shank 532 of the stop link 53. An end plate 531*a* is located at an end of the outer tube 531 such that the spring 533 is biased between the enlarged head of the stop link 53 and the end plate 531*a*. The stop link 53 extends through the side tube 26 and is disengageably inserted into the positioning hole 412 of the tubular member 41. The connection member 54 extends through the corresponding post 2 and is connected between the first link 51 and the one of the passive links 32. The connection member 54 is a steel cable and is pulled by the passive link 32 when the lever 33 is pivoted. After the connection member 54 is released, the spring 533 pushes the stop link 53 into the positioning hole 412 again.

Figure 11:
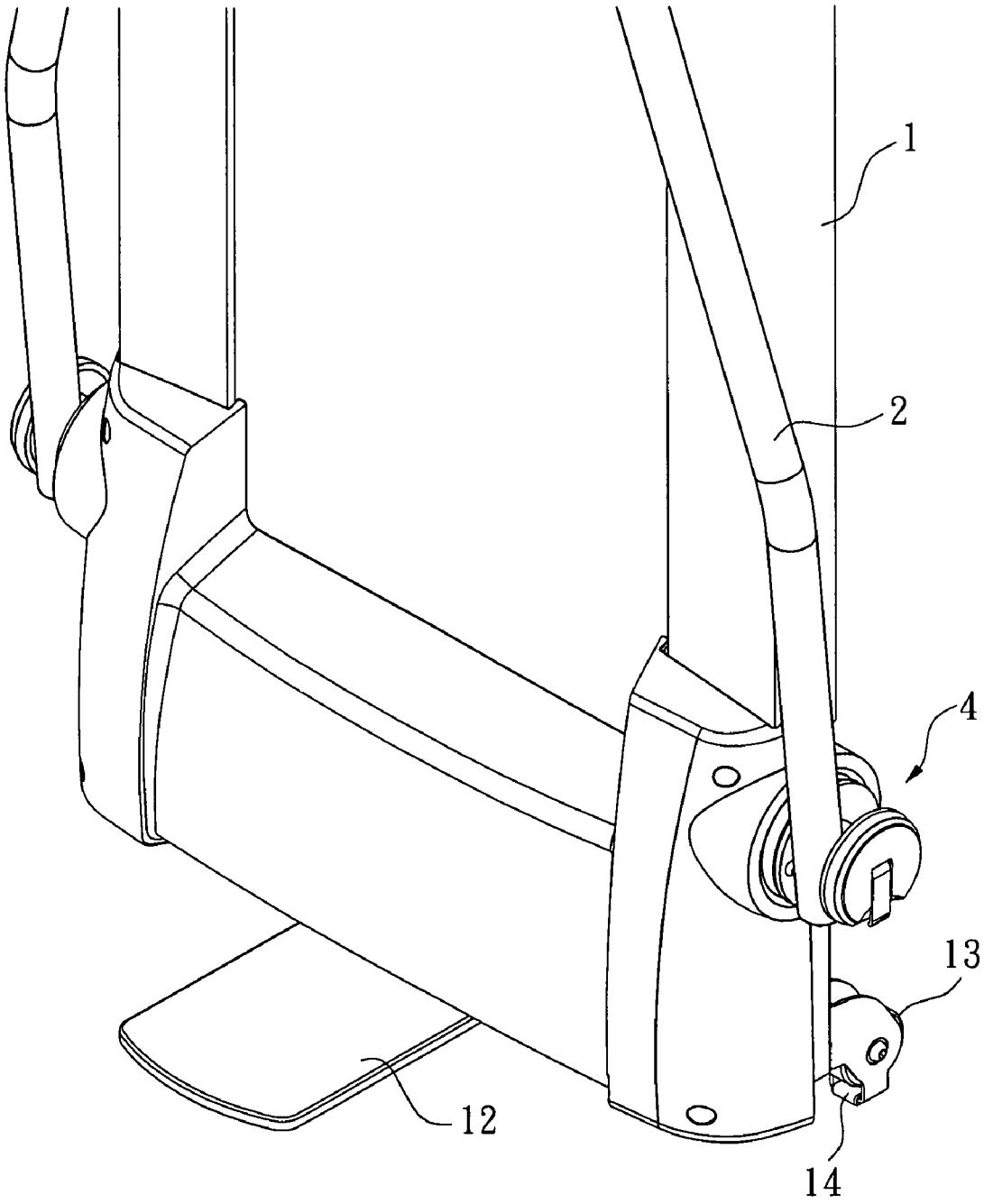
FIG. 11 shows a preferred embodiment that the support stand is pivoted to support the upright base.

The base 1 includes rollers 13 connected to an underside thereof and each roller 13 is connected with a stand frame 14 which includes a flat end so that when the base 1 is oriented upright as shown in FIGS. 2 and 11, the flat end of the stand frame 14 is on the floor to support the base 1. At least one support stand 12 is connected to an end of the base 1 and is a pivotable stand which pivots about a pivotable protrusion 121 at a center of the at least one support stand 12. The support stand 12 is connected to the base 1 perpendicularly when the base 1 is folded and orientated upright. The at least one support stand 12 prevents the base 1 from falling down.

Figure 12:
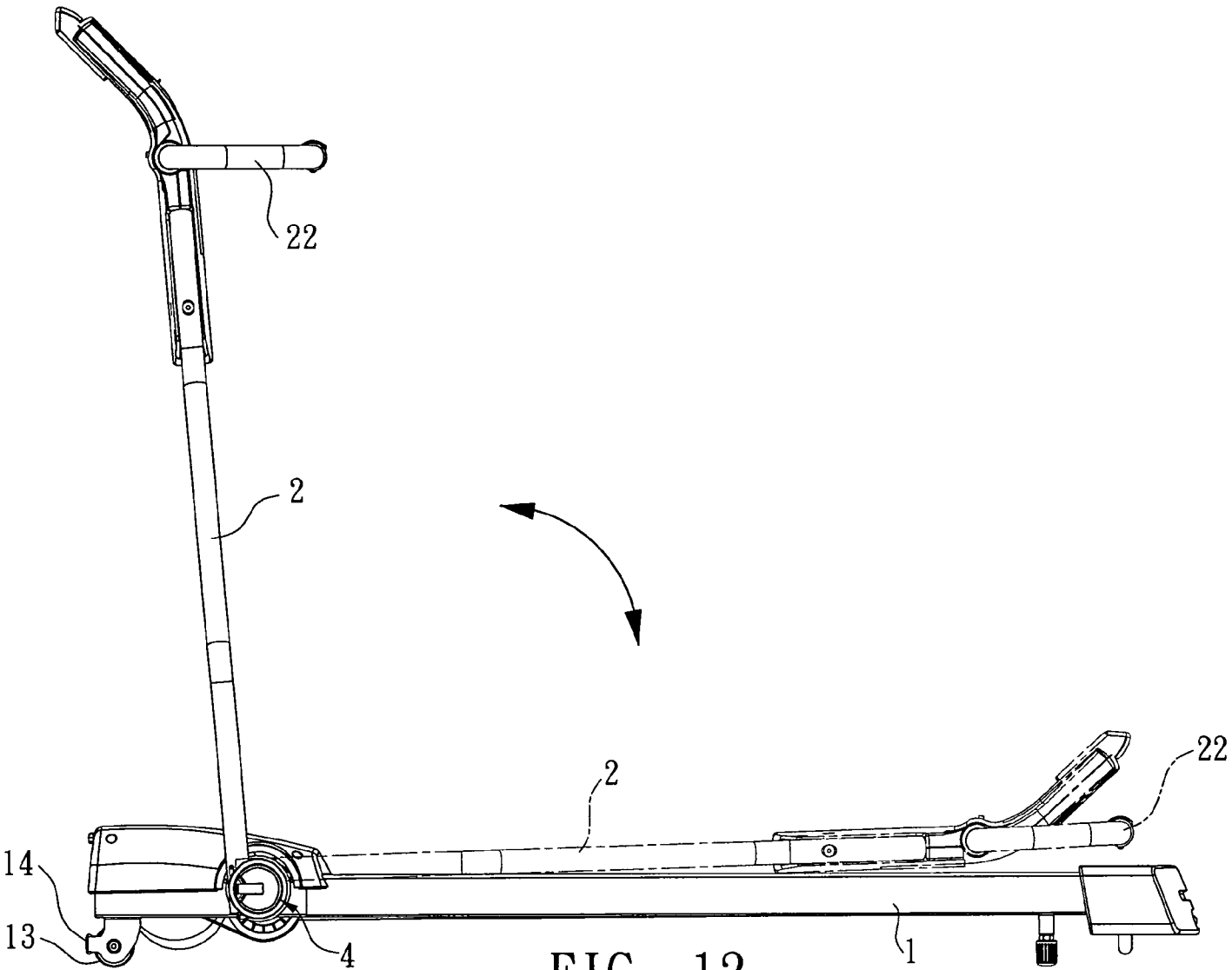
FIG. 12 shows a preferred embodiment that the posts are pivoted toward the base.

When folding the treadmill, the two quick release devices 45 are loosened by lifting the operation levers 451 to disengage the second stop portion 43 from the first stop portion 42. The lever 33 is then pivoted to shift the transverse link 31 so that the two passive links 32 are pivoted and the two insertions 321 are pulled out from the restriction ports 221*a* of the two pivotal ends 221 of the handle 22. The handle 22 is then pivoted upward. The movement of the passive links 32 drives the connection member 54 to pivot the first link 51 which drives the second link 52 and the stop link 53 is disengaged from the positioning hole 412 of the tubular member 41. The posts 2 are then pivoted toward the base 1 as shown in FIG. 12. It is noted that the step for folding the posts 2 can also be operated in reverse sequences.

The handle 22 on the posts 2 can be positioned by the positioning units 3 when it is pivoted upward or downward. The insertions 321 are inserted into the restriction ports 221*a* so as to restrict the handle 22 from being pivoted upward or downward by accidentally touched and this provides a safety feature when the user is using the treadmill. Furthermore, when folding the foldable treadmill, the first and second securing units 4, 5 have to be ensured released before the posts 2 are able to be pivoted toward the base 1. In other words, both of the first and second securing units 4, 5 are released before the posts 2 can be folded. This avoids the posts 2 from unexpectedly pivoting during use.

Figure 13:
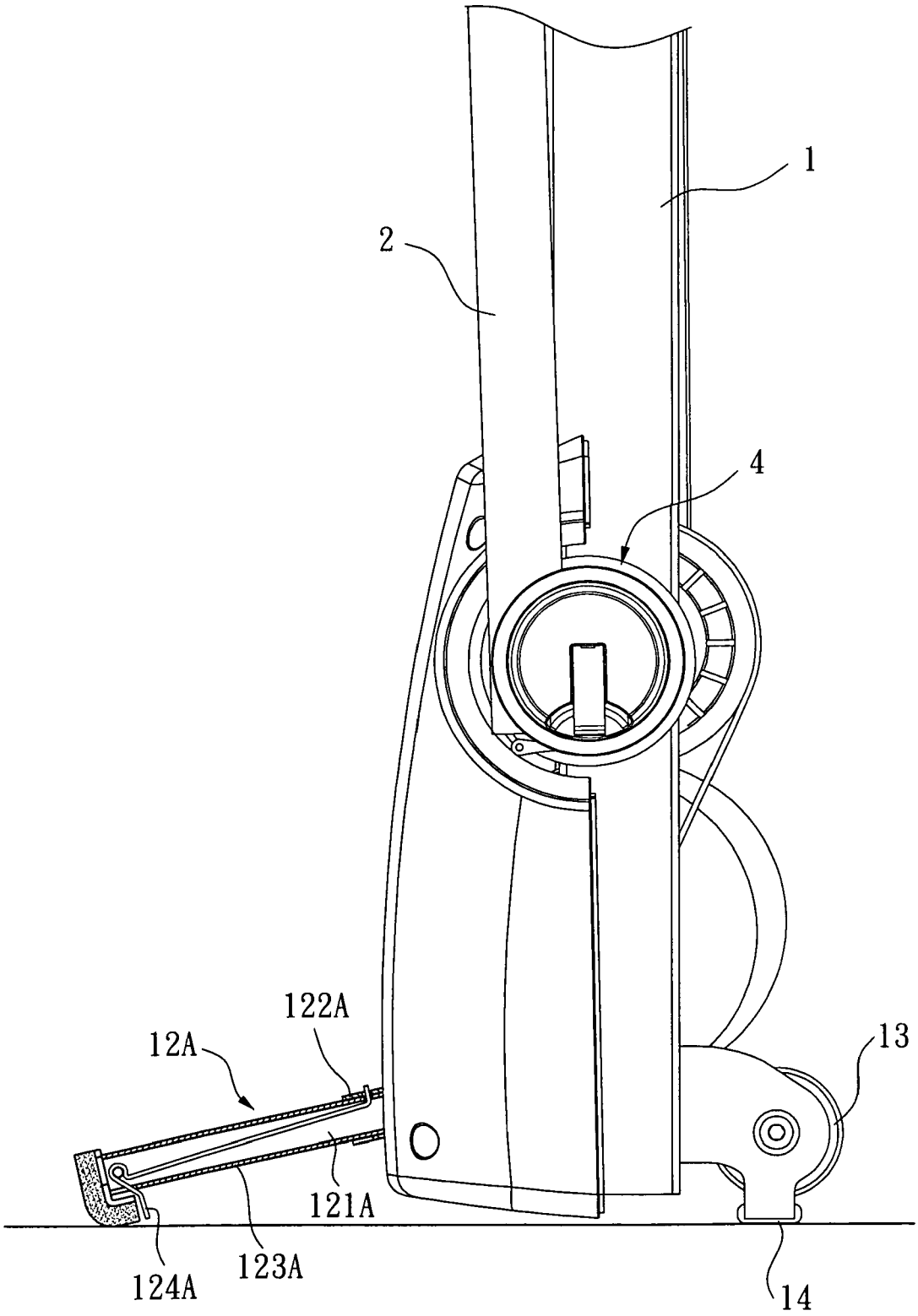
FIG. 13 shows a second embodiment of the support stand of the foldable treadmill of the present invention.

FIG. 13 shows a second embodiment of the at least one support stand 12A which includes an outer tube 122A which has an axial slot 121A. An inner portion 123A is retractably inserted into the outer tube 122A and a positioning switch 124A is located between the outer tube 122A and the inner portion 123A. The inner portion 123A extends out from the outer tube 122A and contacts the floor when the base 1 is folded and orientated upright.

Figure 14:
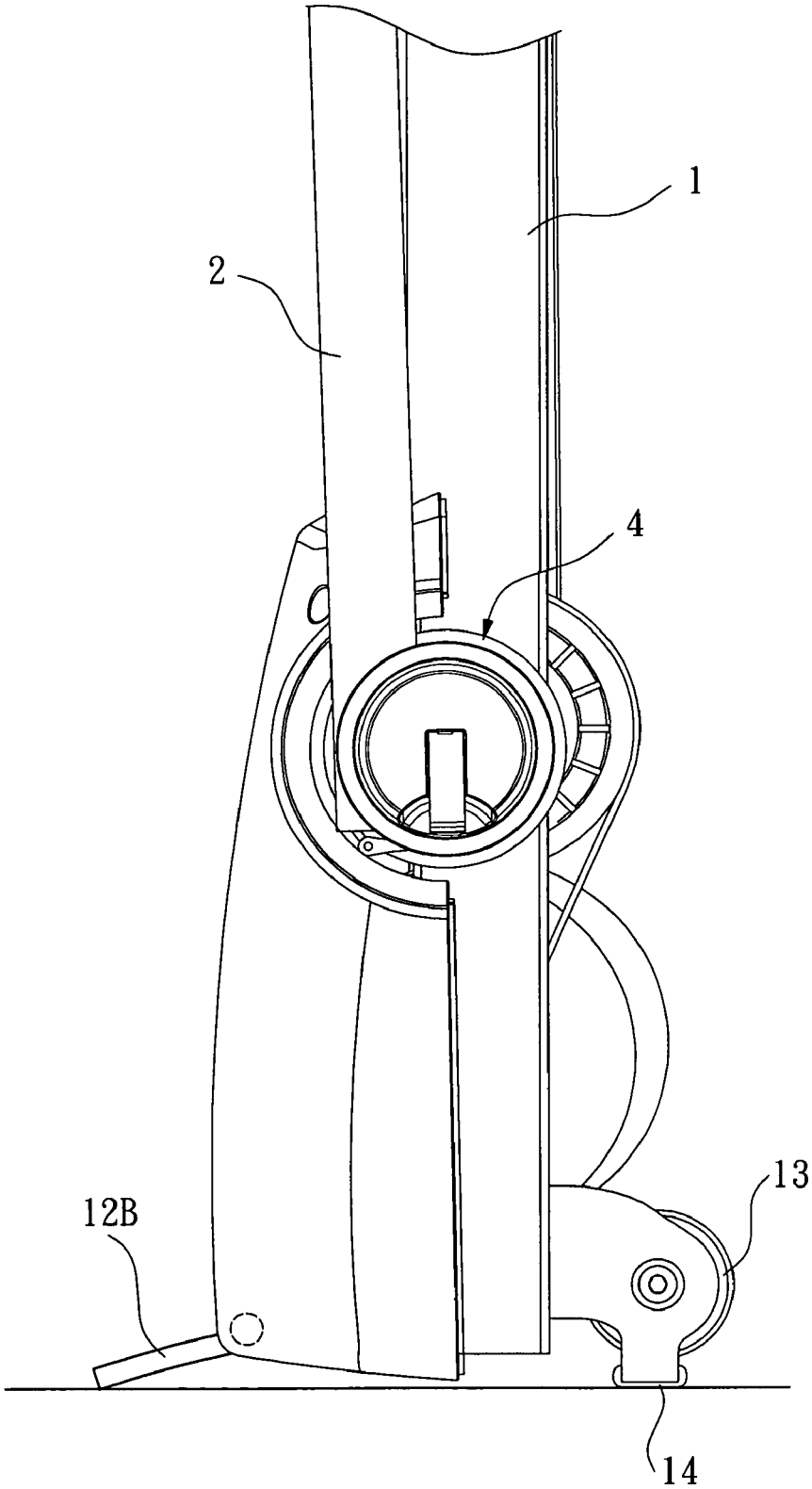
FIG. 14 shows a third embodiment of the support stand of the foldable treadmill of the present invention.

FIG. 14 shows a third embodiment of the at least one support stand of the foldable treadmill of the present invention, wherein the at least one support stand 12B includes a support piece which is pivoted outward and adapted to contact the floor.

Figure 15:
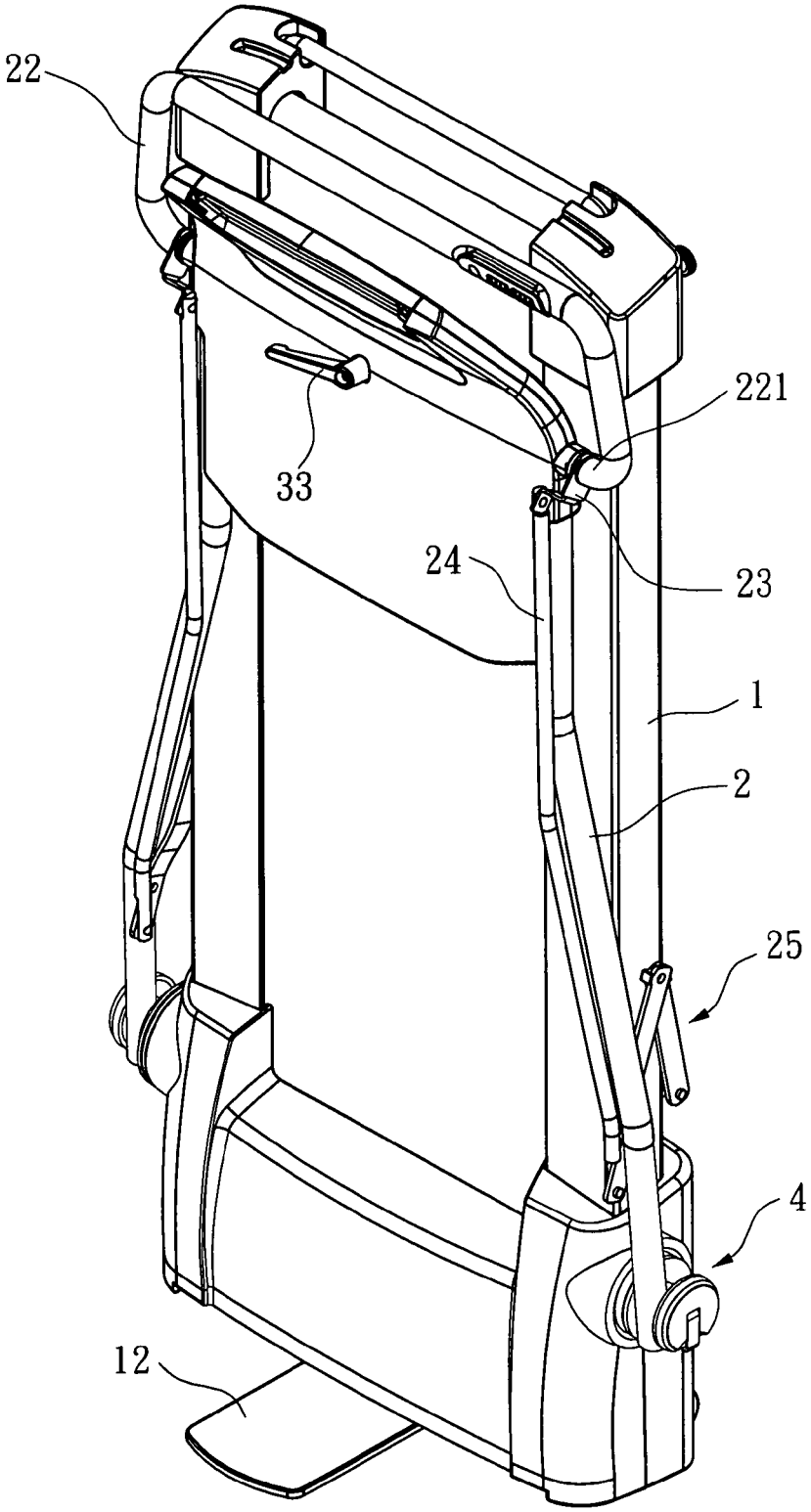
FIG. 15 shows another embodiment of the foldable treadmill of the present invention.
Figure 16:
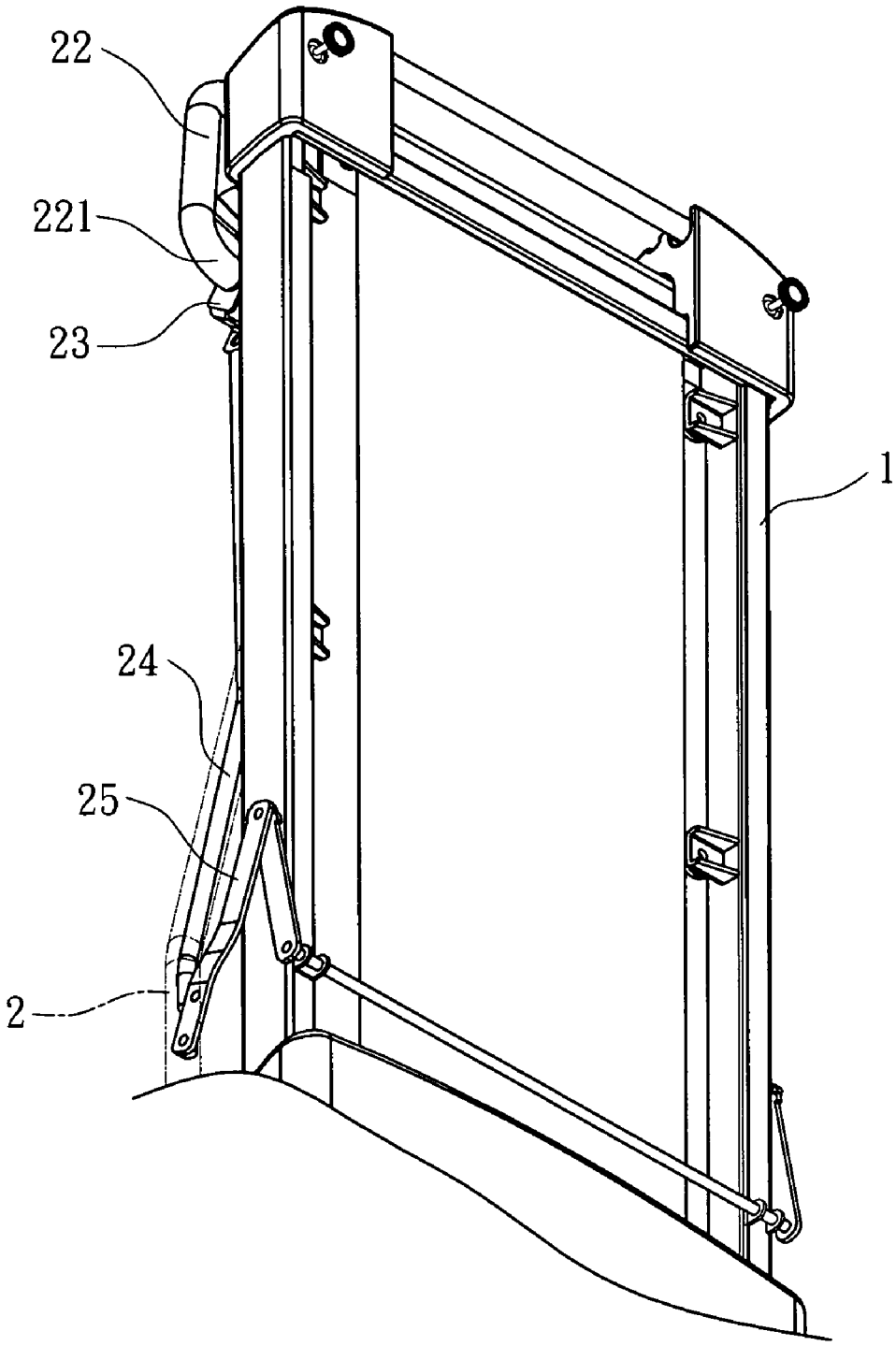
FIG. 16 shows a preferred embodiment that the link unit and connection plate are connected to the posts and the base.
Figure 17:
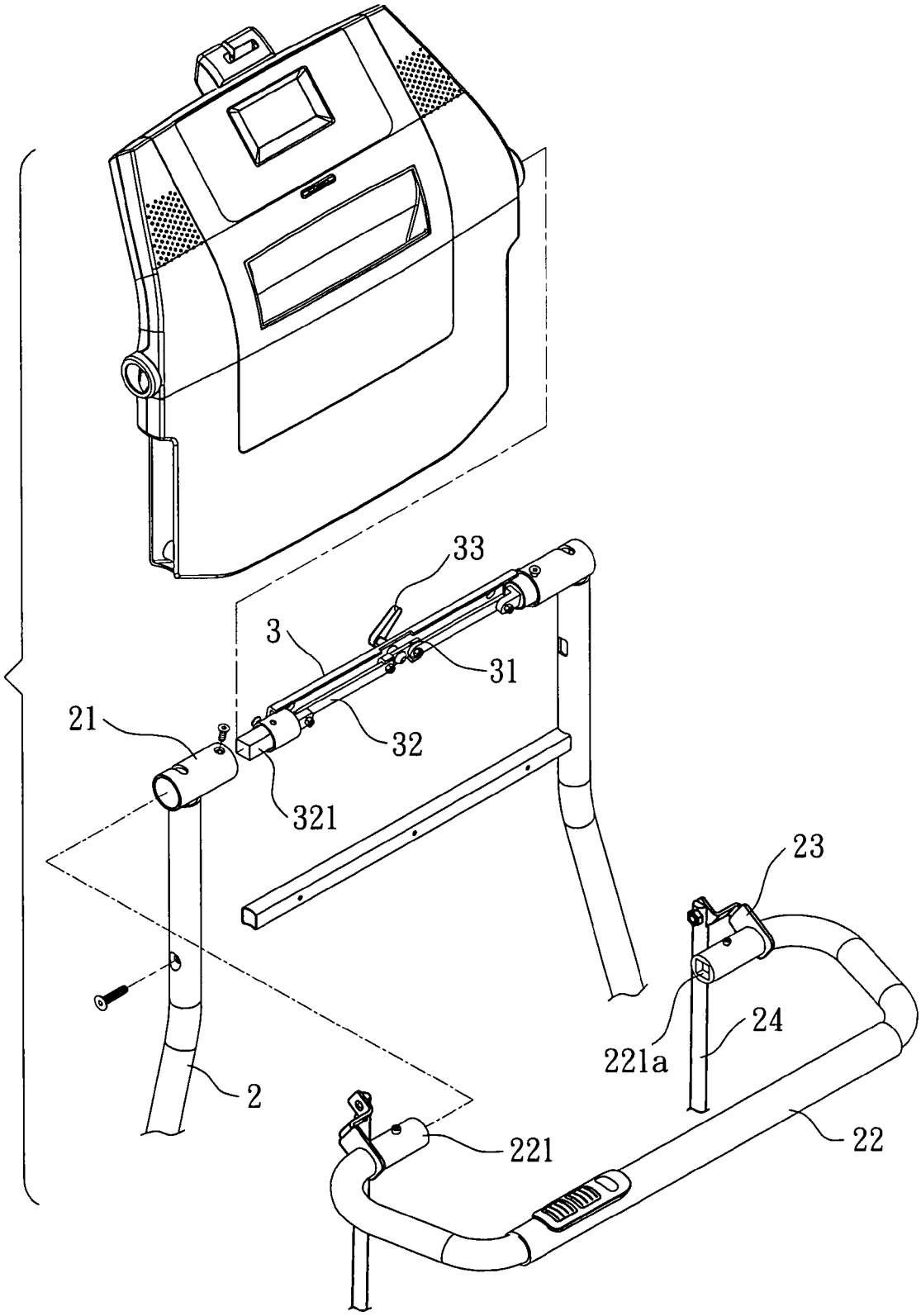
FIG. 17 shows an exploded view to show a preferred embodiment that the connection plate is connected to the handle and the connection rod is connected to the connection plate.
Figure 18:
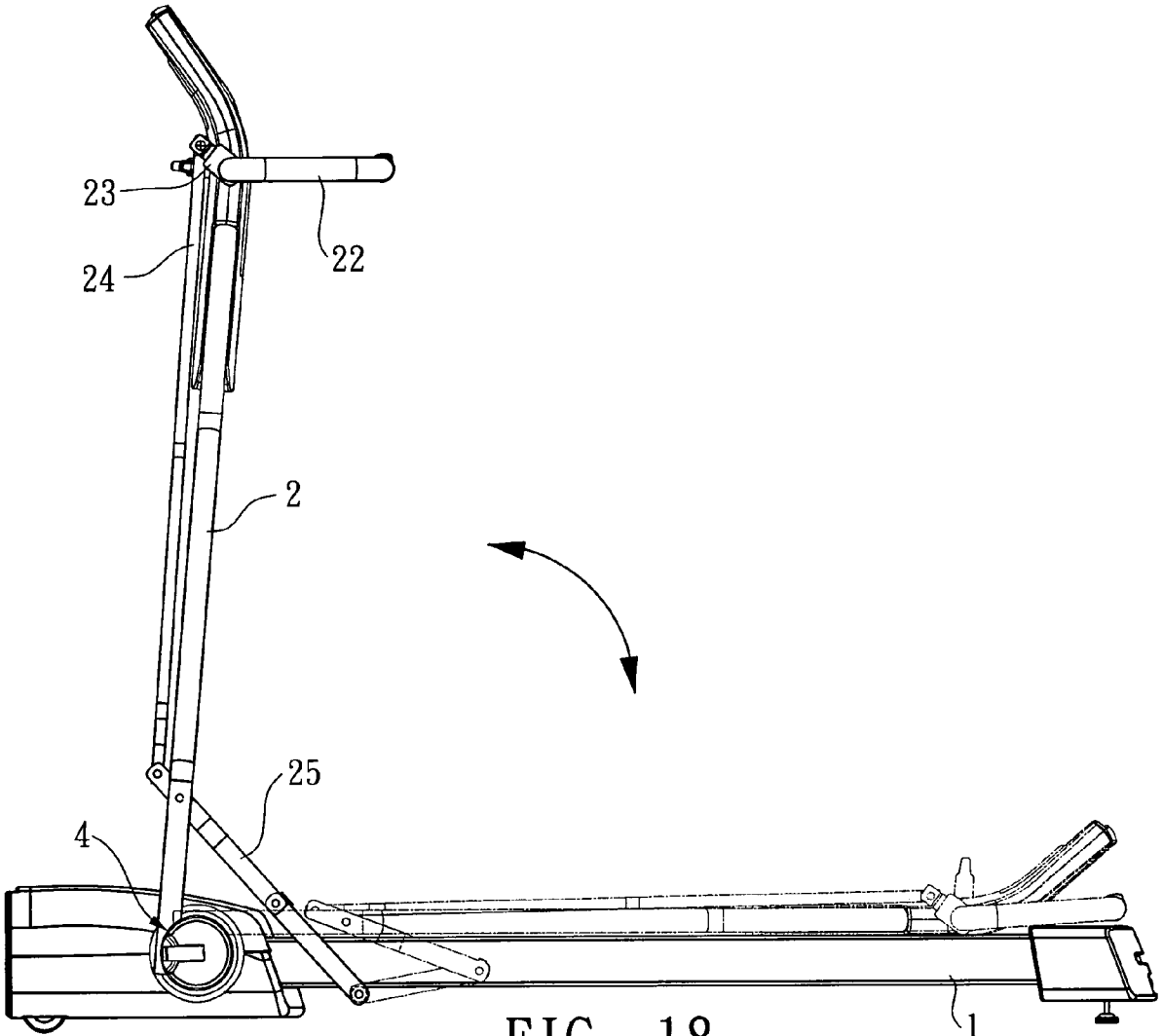
FIG. 18 shows a preferred embodiment that the two elongate plates are pivoted to be straight when the posts are pivoted upward and folded when the posts are pivoted toward the base.
Figure 19:
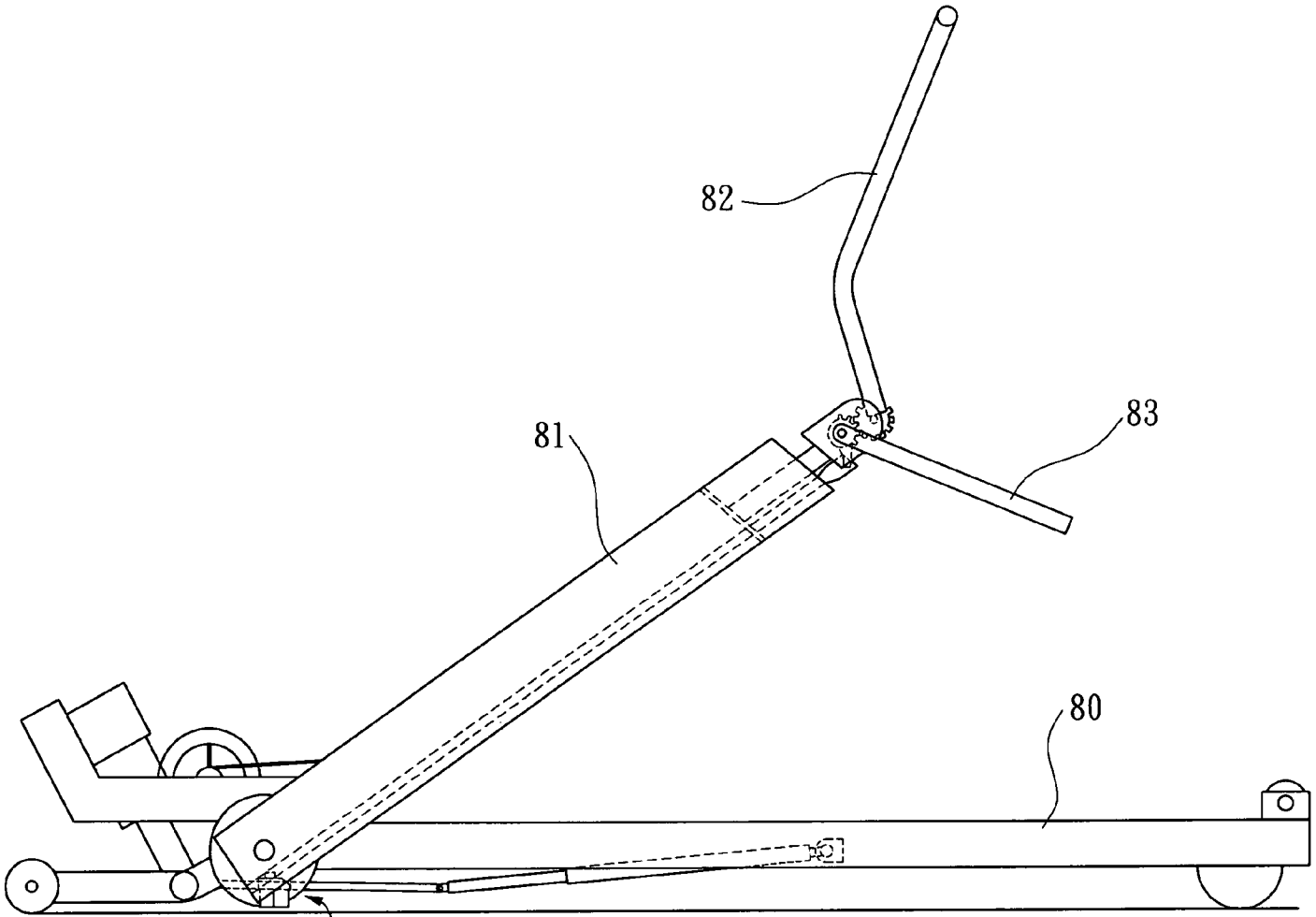
FIG. 19 PRIOR ART
FIG. 19 shows a conventional foldable treadmill.
Figure 20:
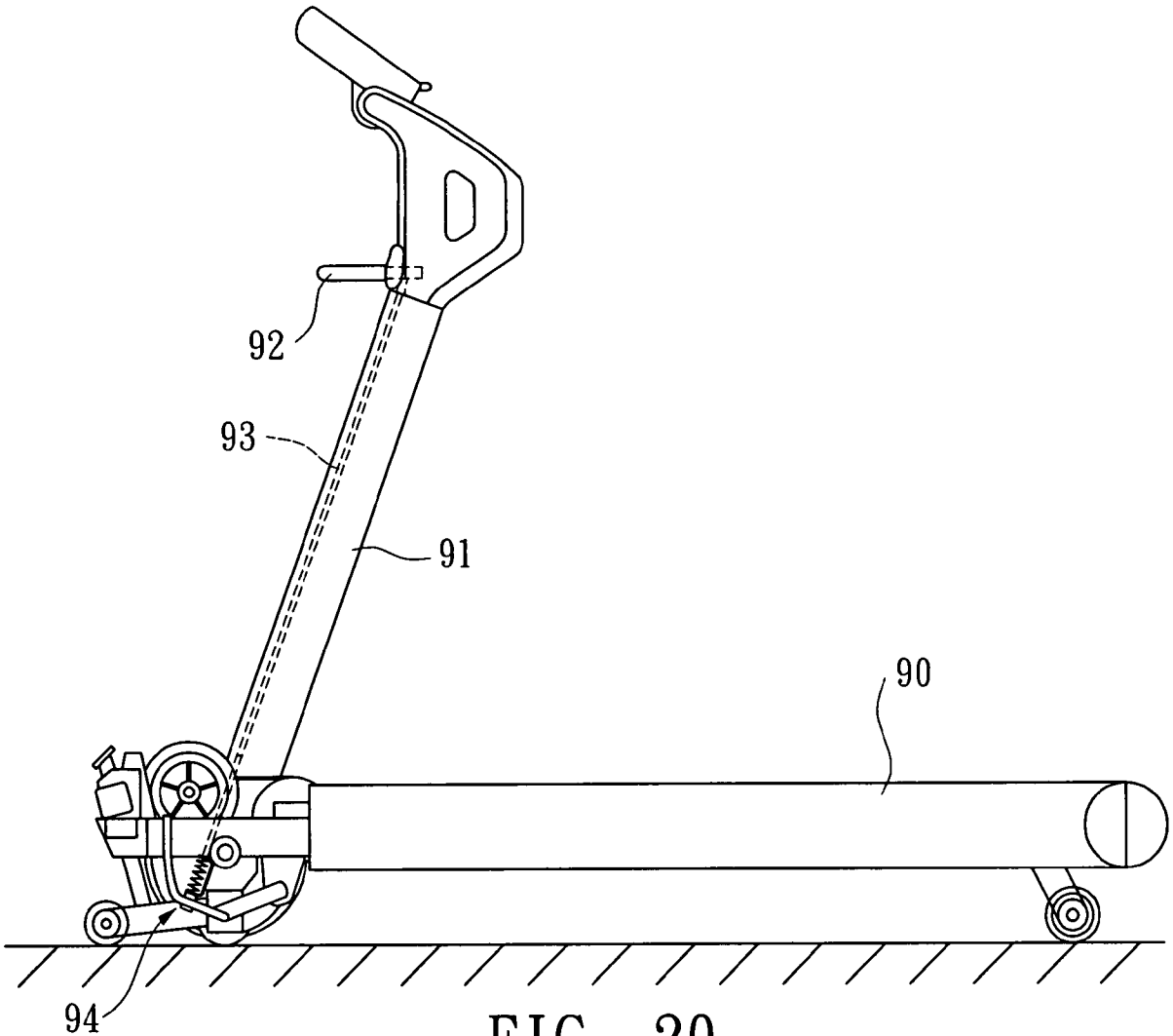
FIG. 20 PRIOR ART
FIG. 20 shows another conventional foldable treadmill.

FIGS. 15 to 17 show another embodiment of the foldable treadmill of the present invention, wherein two guiding units 23 are connected to the two pivotal ends 221. Two connection rods 24 are pivotably and respectively connected between the two guiding units 23 and two pivotal link units 25. Each pivotal link unit 25 composed of two elongate plates which are pivotably connected to each other. One of the two elongate plates of each pivotal link unit 25 is pivotably connected to the connection rod 24 and the post 2 corresponding thereto. The other elongate plate is pivotably connected to the base 1. The two elongate plates of each of the link units 25 are extended to be substantially straight to support the posts 2 relative to the base 1 when using the treadmill. Two first securing units 4 are located between the two posts 2 and the base 1 so as to position the posts 2. As shown in FIG. 18, when folding the treadmill, the handle 22 is pivoted upward, the guiding units 23 are pivoted to lower the connection rods 24 which pivot the link units 25 about respective pivot points at the base 1 and the posts 2 are able to be pivoted toward the base 1.

While we have shown and described the embodiment in accordance with the present invention, it should be clear to those skilled in the art that further embodiments may be made without departing from the scope of the present invention.

What is claimed is:

1. A foldable treadmill comprising:
- a base with an endless belt mounted thereon;
- two posts pivotably connected to the base;
- a handle having at least one pivotal end, the handle pivotably connected to the two posts; and
- a positioning unit disposed between the two posts comprising:
  - at least one passive link having a first end pivotably connected to a transverse link;
  - a lever pivotally connected to the transverse link;
  - at least one insertion connected to a second end of the passive link;
  - a restriction port being defined at the pivotal end of the handle for disengageably mating with the insertion to restrict the handle from pivoting thereabout;
- whereby displacing the lever about the connection to the transverse link drives the positioning unit into or out of the restriction port in order to pivot the handle.

2. The foldable treadmill as claimed in claim 1, wherein the base includes rollers connected to an underside thereof and each roller is connected with a stand frame having a flat end.

3. The foldable treadmill as claimed in claim 1, wherein at least one support stand is connected to an end of the base.

4. The foldable treadmill as claimed in claim 3, wherein the support stand is a pivotable stand intersecting the base when folded and orientated upright.

5. The foldable treadmill as claimed in claim 3, wherein the support stand includes an outer tube having an axial slot, an inner portion retractably inserted into the outer tube and a positioning switch located between the outer tube and the inner portion, the inner portion extending out from the outer tube and adapted to contact a floor when the base is folded and orientated upright.

6. The foldable treadmill as claimed in claim 3, wherein the support stand includes a support piece pivoted outward and adapted to contact a floor.

7. A foldable treadmill comprising:
- a base with an endless belt mounted thereon;
- two posts pivotably connected to the base;
- a handle pivotably connected to the two posts and including at least one pivotal end which is connected the two posts; and
- a positioning unit disposed between the two posts comprising:
  - at least one passive link having a first end pivotably connected to a transverse link;
  - a lever pivotally connected to the transverse link;
  - at least one insertion connected to a second end of the passive link;
- a restriction port being defined at the pivotal end of the handle for disengageably mating with the insertion to restrict the handle from pivoting thereabout; and
- a first securing unit located between the base and the two posts and the first securing unit including a first stop portion located on one side of the base, a tubular member extending from the first stop portion and including a positioning hole, one of the two posts having a second stop portion frictionally matched with the first stop portion, a quick release device including a lever having a cam-shaped end and a threaded rod pivotably connected to the cam-shaped end, the threaded rod extending through a frame, the second stop portion and threadedly connected with the inner threads defined in the tubular member.

8. The foldable treadmill as claimed in claim 7, wherein a second securing unit is connected to a side tube on at least one of the two posts and includes a first link having a first end connected with a connection member and a second end of the first link is pivotably connected to a first end of a second link, a second end of the second link is pivotably connected a stop link, the stop link extends through the side tube and is engageably inserted into the positioning hole of the tubular member, the connection member extends through the post and connected between the first link and the at least one passive link.

9. The foldable treadmill as claimed in claim 7, wherein the base includes rollers connected to an underside thereof and each roller is connected with a stand frame having a flat end.

10. The foldable treadmill as claimed in claim 7, wherein at least one support stand is connected to an end of the base.

11. The foldable treadmill as claimed in claim 10, wherein the support stand is a pivotable stand intersecting the base when folded and orientated upright.

12. The foldable treadmill as claimed in claim 10, wherein the support stand includes an outer tube having an axial slot, an inner portion retractably inserted into the outer tube and a positioning switch located between the outer tube and the inner portion, the inner portion extending out from the outer tube and adapted to contact a floor when the base is folded and orientated upright.

13. The foldable treadmill as claimed in claim 10, wherein the support stand includes a support piece pivoted outward and adapted to contact a floor.

14. A foldable treadmill comprising:
- a base with an endless belt mounted thereon;
- two posts pivotably connected to the base;

a handle pivotably connected to the two posts and including at least one pivotal end which is connected the two posts, and a positioning unit disposed between the two posts comprising:

at least one passive link having a first end pivotably connected to a transverse link;

a lever pivotally connected to the transverse link;

at least one insertion connected to a second end of the passive link;

a restriction port being defined at the pivotal end of the handle for disengageably mating with the insertion to restrict the handle from pivoting thereabout;

a guiding unit connected to the one of two pivotal ends, a connection rod pivotably connected to the guiding unit and a pivotal link unit, the pivotal link unit composed of two elongate plates pivotably connected each to the other, one of the two elongate plates of the pivotal link unit pivotably connected to the connection rod and the post, the other elongate plate pivotably connected to the base, the two elongate plates of the pivotal link unit being extended to be substantially straight to support the posts relative to the base when using the treadmill;

whereby when folding the treadmill, the handle is pivoted upward, the guiding unit pivots to lower the connection rod which pivots the link unit about a pivot point at the base and the posts being pivoted toward the base.

15. The foldable treadmill as claimed in claim 14, wherein the base includes rollers connected to an underside thereof and each roller being connected with a stand frame having a flat end.

16. The foldable treadmill as claimed in claim 14, wherein at least one support stand is connected to an end of the base.

17. The foldable treadmill as claimed in claim 16, wherein the support stand is a pivotable stand intersecting the base when the base is folded and orientated upright.

18. The foldable treadmill as claimed in claim 16, wherein the support stand includes an outer tube having an axial slot, an inner portion retractably inserted into the outer tube and a positioning switch located between the outer tube and the inner portion, the inner portion extends out from the outer tube and adapted to contact a floor when the base is folded and orientated upright.

19. The foldable treadmill as claimed in claim 16, wherein the support stand includes a support piece pivoted outward and adapted to contact a floor.

20. The foldable treadmill as claimed in claim 14, wherein a first securing unit is located between the base and the two posts.

* * * * *